United States Patent [19]

de Wilde

[11] Patent Number: 4,940,198

[45] Date of Patent: Jul. 10, 1990

[54] BRACKET UNIT FOR FIXING A ROOF GUTTER

[76] Inventor: Gerrit J. de Wilde, Dedemsvaartseweg Noord 106, 7775 AK Lutten, Netherlands

[21] Appl. No.: 270,001

[22] Filed: Nov. 14, 1988

[30] Foreign Application Priority Data

Nov. 19, 1987 [NL] Netherlands ..... 8702770

[51] Int. Cl.[5] ..... E04D 13/06

[52] U.S. Cl. ..... 248/48.1

[58] Field of Search ..... 248/48.1, 48.2, 58, 248/62, 70, 74.1, 237, 286, 317, 323, 324; 411/84, 85, 112, 104, 174, 175

[56] References Cited

U.S. PATENT DOCUMENTS

| | | | |
|---|---|---|---|
| 304,425 | 9/1884 | Gould | 248/48.2 |
| 707,941 | 8/1902 | Pope | 248/48.1 |
| 749,419 | 1/1904 | Bohnert | 248/48.1 |
| 948,901 | 2/1910 | Nakashjian | 248/48.1 |
| 972,291 | 10/1910 | Thomas | 248/286 |
| 1,017,174 | 2/1912 | Sander | 248/48.1 |
| 1,384,856 | 7/1921 | Salmonsen . | |
| 1,478,837 | 12/1923 | Rachlin | 248/48.1 |
| 1,554,778 | 9/1925 | Berger | 248/48.1 |
| 1,558,385 | 10/1925 | Meunier | 248/48.2 |
| 3,126,038 | 3/1964 | Jaworski | 411/112 |
| 3,809,347 | 5/1974 | Pekarek . | |
| 4,553,357 | 11/1985 | Pepper . | |
| 4,676,706 | 6/1987 | Inaba | 411/175 |

FOREIGN PATENT DOCUMENTS

| | | | |
|---|---|---|---|
| 880052 | 6/1972 | Belgium . | |
| 376025 | 5/1923 | Fed. Rep. of Germany | 248/70 |
| 1509122 | 5/1969 | Fed. Rep. of Germany . | |
| 2061367 | 6/1972 | Fed. Rep. of Germany | 248/48.2 |
| 74506 | 2/1981 | Fed. Rep. of Germany . | |
| 2945503 | 5/1981 | Fed. Rep. of Germany . | |
| 2312683 | 12/1976 | France . | |
| 1474956 | 2/1982 | France . | |
| 1406679 | 3/1984 | France . | |
| 571133 | 12/1975 | Switzerland | 248/48.2 |
| 672950 | 5/1972 | United Kingdom | 248/48.1 |
| 2176824 | 1/1987 | United Kingdom . | |

*Primary Examiner*—Ramon O. Ramirez
*Assistant Examiner*—Robert A. Olson
*Attorney, Agent, or Firm*—Lucas & Just

[57] ABSTRACT

Bracket unit for fixing a gutter to an eaves section (1), comprising fixing means consisting of a bolt (6) for insertion through a bore formed in the eaves, and mating therewith a nut (4), a bracket part (10; 31; 35, 36), a curved bottom end part of which is suitable for supporting the gutter, and an elongated supporting part (3; 20) with an insertion space (8; 29) for the accommodation and retention therein of the other, top end part (9; 30; 37) of the bracket part (10; 31; 35, 36), a supporting surface to be fitted against a bottom side of the eaves, and a bore (12, 15; 25) for passage of the bolt (6), said bore being directed at right angles to the supporting surface and running through the supporting surface, and also comprising positioning means for positioning the supporting part (3; 20) and the bracket part (10; 31; 35; 36) relative to each other from a number of positions, while the supporting part (3; 20) consists of only one part which is to be fitted on the bottom side of the roof section (1), and the bore (12, 15; 25) of the supporting part (3; 20) has a nut nesting space (12; 26) with limitations which are capable of retaining the nut (4) in the nesting space (12; 26) in such a way that it cannot be turned or lost.

12 Claims, 4 Drawing Sheets

BRACKET UNIT FOR FIXING A ROOF GUTTER

Figure 7:
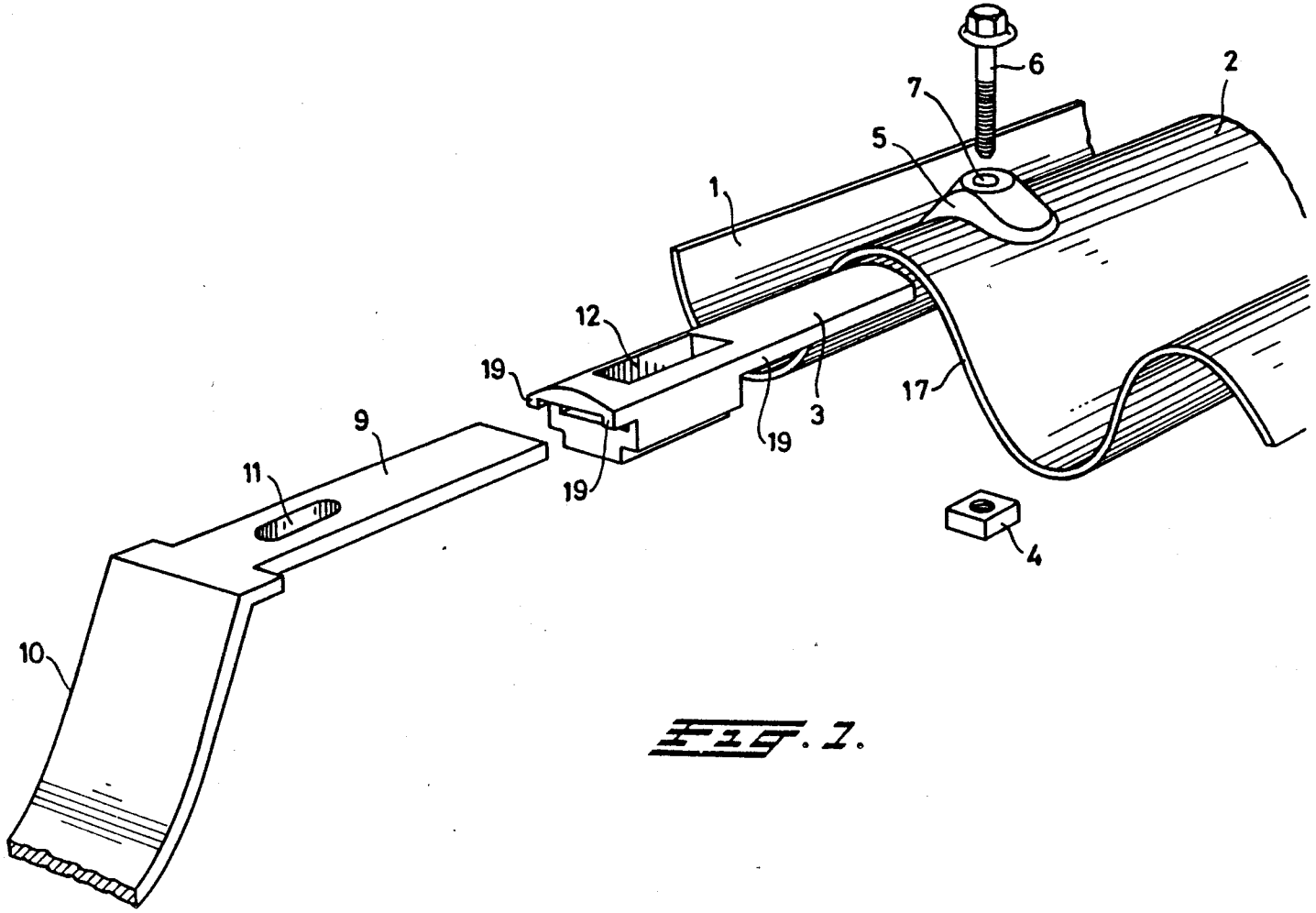

The invention relates to a bracket unit according to the preamble of claim 1.

Such a bracket unit is known from German patent application No. 2,945,503. In the known bracket unit the supporting part comprises first and second parallel-running plate pieces for forming an insertion area for the end part of the bracket part, the distance between the first and second plate pieces being equal to the thickness of the end part of the bracket part. At the insertion aperture of the insertion space for the bracket part a downward-bent lip goes out from the second, top plate piece, in order to prevent displacement of the bracket part inserted into the supporting part. Provision is made on the top side of the second plate piece near the end of the insertion aperture for a spacer, on which a third plate piece running parallel to the other plate pieces is fixed. The second and third plate pieces have opposite the end with the spacer a bore for allowing through the bolt via the bore formed in the eaves section.

The disadvantage of the known bracket unit is that when the distance between the second and third plate pieces is such that the bracket unit can be pushed easily over the eaves section after obtaining the correct positioning, in which the bores for the bolt are in line, in order to maintain the correct positioning, the bracket unit must be held fast, the bolt must be inserted through the bores in the nut, and the bolt or the nut must be retained to prevent them from turning at the same time. Since the bolt must be tightened user has to carry out various actions at the same time, often standing on a ladder, this constitutes an unsafe situation, while fixing the bracket unit to the roof takes a relatively long time. If the distance between the second and third plate pieces is such that the bracket unit is difficult to slide over the eaves section, the user will have difficulty in finding the correct position in which the bores for the bolt are in line with each other. This is relatively time-consuming and, in order to save time, the user could put his head above or below the eaves section to see whether and to what extent the bores are in line. However, this also constitutes an unsafe situation.

Another disadvantage of the known bracket unit is that it is suitable only for use on eaves sections which are of essentially the same thicknesses, so that a relatively large number of bracket units of various dimensions have to be manufactured and held in stock, which makes the cost of the known bracket unit relatively high.

The object of the invention is to eliminate the disadvantages of the known bracket unit.

This object is achieved according to the invention for the bracket unit of the type referred to in the preamble to claim 1 by means of the measures mentioned in the characterizing part of claim 1. Since the nut is fitted in the supporting part in advance and cannot turn therein or be lost therefrom, the user needs only two parts when fitting the bracket unit on the roof: the bolt and the supporting part. Since the user can insert the bolt first through the bore in the eaves section, the user can quickly find the correct positioning of the supporting part. This means that the bracket unit can be fixed easily, safely and quickly to the roof.

The bore of the supporting part for the passage of the bolt is preferably formed by a slot whose longitudinal axis runs essentially parallel to the longitudinal axis of the supporting part, and in which the nut nesting space extends below the slot for taking the nut so that it can slide in the lengthwise direction of the supporting part. This means that, while the supporting part is being fixed to the roof and before the bolt is tightened fully, the supporting part can be slid in the lengthwise direction thereof to obtain the desired position relative to the eaves. When the bore for the bolt is being made in the eaves section, the desired distance between the bore and the eaves does not therefore have to be so accurate, so that said bore can be produced more quickly.

Instead of the bore for the supporting part for the bolt being designed as a slot, or in addition thereto, a bore in an end part of the bracket part to be inserted into the supporting part can be designed as a slot, in order to permit sliding of the supporting part and/or the bracket part in the lengthwise direction of the supporting part and this end part before the bolt is tightened.

Figure 2B:
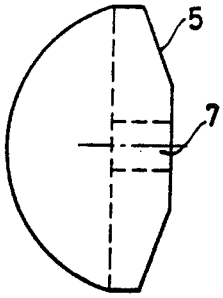
Figure 2A:
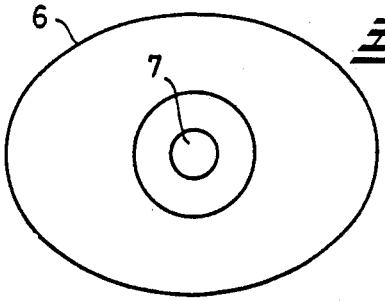
Figure 2C:
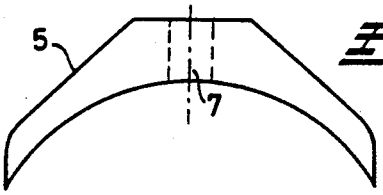
Figure 3B:
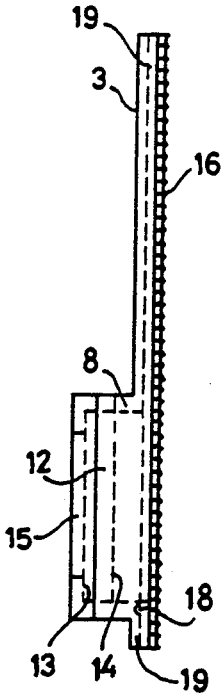
Figure 3A:
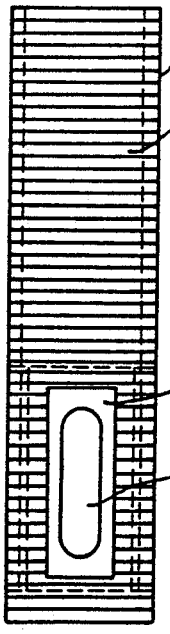
Figure 3C:
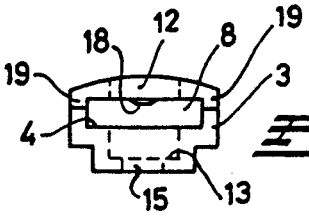
Figure 4A:
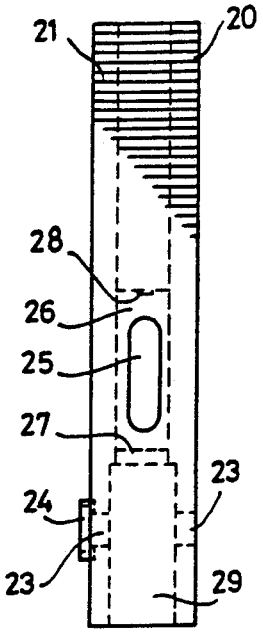
Figure 4B:
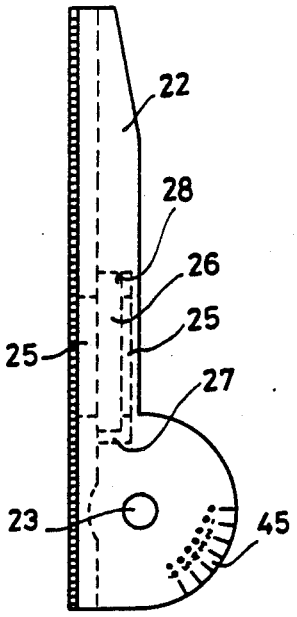
Figure 4C:
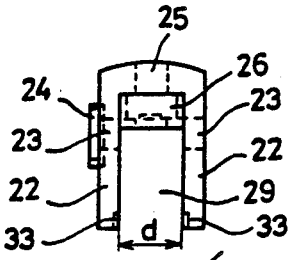
Figure 5:
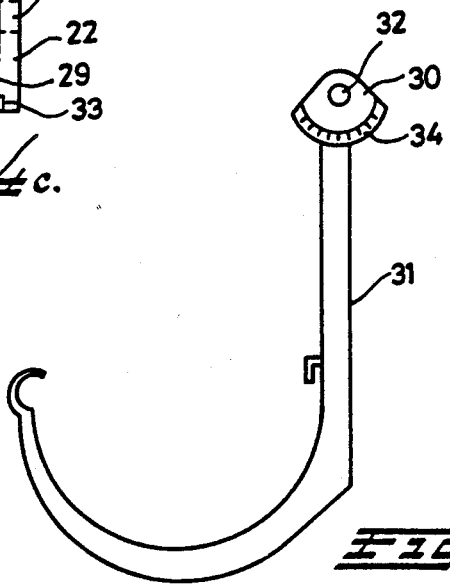
Figure 6A:
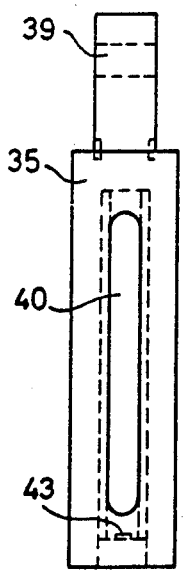
Figure 6B:
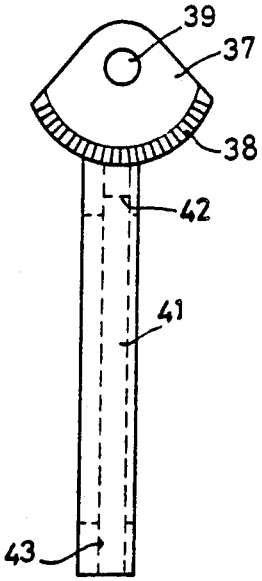
Figure 7:
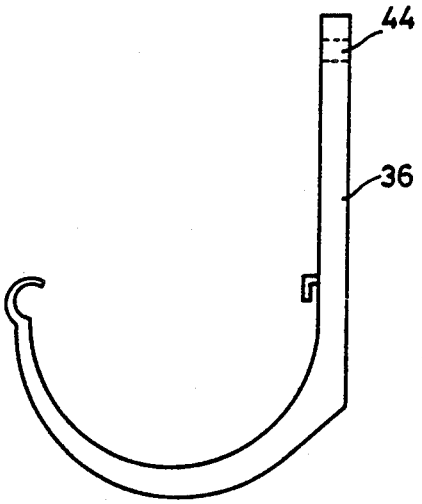

These and other features of the invention will be explained with reference to the embodiments of the bracket unit according to the invention shown in the attached drawing. In the drawings:

FIG. 1 shows in perspective a first embodiment of the bracket unit according to the invention;

FIGS. 2*a*, 2*b* and 2*c* show a top view, a side view and a front view respectively of a washer of the bracket FIGS. 3*a*, 3*b* and 3*c* show a top view, a side view and a front view respectively of a supporting part of the bracket unit shown in FIG. 1;

FIGS. 4*a*, 4*b* and 4*c* show a top view, a side view and a front view respectively of a supporting part of a second embodiment of the bracket unit according to the invention;

FIG. 5 shows a side view of a bracket unit for use with the supporting part shown in FIG. 4;

FIGS. 6*a* and 6*b* show a front view and a side view respectively of a first sub-part of a bracket part comprising two sub-parts for use with the supporting part shown in FIG. 4 and FIG. 7 shows a second sub-part of the bracket part for use with the sub-part shown in FIG. 6.

The bracket unit according to the invention shown in FIG. 1, which is used with a corrugated sheet 1 of a roof, comprises an elongated supporting part 3 which is fitted against the bottom side of a corrugated ridge 2 of the corrugated sheet 1 and a bracket part 10 which is inserted into the supporting part 3, and a bottom end (not shown) of which is suitable for supporting a gutter (not shown).

A nut 4 is fitted in the supporting part 3 in a manner which means that it cannot be turned or lost, as explained below. The corrugated ridge 2 has a hole (not shown), on which a washer 5 with a central bore 7 is placed when the bracket unit is being fixed to the corrugated sheet 1, for the purpose of passing through from the top a bolt 6 which can be screwed in the nut 4. The bottom side of the washer 5 is of a shape which is adapted to the top side of the corrugated ridge 2, in order to ensure uniform distribution of the pressure caused by tightening of the bolt 6. In order to obtain the best possible pre sure distribution with as little material as possible, the projection of the washer in a plane running parallel to the corrugated sheet 1 is preferably an oval shape with a long main axis running at ring angles to the corrugations of the corrugated sheet 1.

The supporting part 3 has a first bore 8 (FIG. 3) which runs in the lengthwise direction of the supporting part 3 and has an insertion space for an elongated end part 9 of the bracket part 10. The end part 9 can be pushed so far into the bore 8 of the supporting part 3 that a bore 11 formed in the end part 9 is in line with the bore formed in the corrugated ridge 2 and a bore formed in the supporting part 3 (explained below) to allow the bolt 6 the pass through. In order to obtain a desired position of the bracket part 10 relative to the corrugated sheet 1, the bore 11 is preferably an elongated shape in the lengthwise direction of the end part 9.

Reinforcement and guide flanges 19 extend from the top side of the supporting part 3 which forms a supporting surface.

The supporting part 3 has on the top side a recess 12 running in the lengthwise direction thereof (FIGS. 1 and 3*a*). The bottom 13 of the recess 12 runs below the level of the bottom 14 of the bore 8. The dimensions of the recess 12 are suitable for placing on the bottom 13 thereof the nut which, as shown, can have a square periphery, and which is retained at its other side by the end part 9 of the bracket part 10 inserted through the bore 8, in such a way that the nut 4 is accommodated in the recess 12 under the end part 9 so that it cannot turn or be lost.

A bore 15 for passing through the bottom end of the bolt 6 is preferably provided in the bottom 13 of the recess 12, depending on the length of the bolt 6 used and the height of the supporting part 3.

The recess 12 and the bolt 15, if present, are preferably elongated in shape in the lengthwise direction of the supporting part 3, so that the nut 4 can be pushed between the end part 9 of the bracket part 10 inserted in the bore 8 and the bottom 13 of the recess 12 for easily obtaining a desired position of the supporting part 3 and/or of the bracket part 10 relative to the corrugated sheet 1. The bore 11 of the end part 9 of the bracket part 10 could then have a circular circumference.

The top side of the supporting part 3 is preferably, as shown in FIG. 3, provided with a number of sharply projecting ribs such as 16, running transversely to the direction of the corrugations of the corrugated sheet 1, for improvement of the contact of the supporting part 3 with the bottom side of the corrugated ridge 2.

Downward-running reinforcement flanges 19 extend on either side of the top side (supporting surface) of the supporting part 3.

When the nut 4 has been placed on the bottom 13 of the recess 12 and the end part 9 of the bracket part 10 is then pushed into the bore 8 of the supporting part 3, the user can slide the supporting part 3 together with the bracket part 10 relative to the corrugated sheet 1 until the bolt 6 can be inserted through the bore (not shown) formed in the corrugated ridge 2 and through the bores 8, 11, 12, 15 of the component parts 3, 10 with the nut 4 therein. Before the bolt 6 is tightened fully, the parts can be displaced further relative to each other, so that good positioning of the bracket part 10 relative to the corrugated sheet 1, and in particular relative to other bracket parts 10 fixed to the corrugated sheet, can be obtained.

Although the elongated shape of the bores for the bolt 6 make the bracket unit according to the invention suitable for many applications, it may be necessary to use different designs of the bracket part 10, for example depending on the slope of the roof, but the same supporting part 3 can always be used. It is therefore possible when manufacturing to produce beforehand a number of combinations of supporting parts 3 containing a nut 4 and bracket parts 10 of different shapes. The end part 9 of the bracket part 10 is preferably held in the bore 8 by friction, so that inadvertent slipping, and consequently loss, is prevented during transportation or fixing of the bracket unit. This can be achieved in a simple manner by means of a projection 18 provided locally in the first bore 8. This means that a large number of bracket units 3, 10 can be fixed simply and safely within a short period of time on the corrugated sheet 1, and all bracket units can be set accurately in line.

For reducing the number of parts of the bracket unit according to the invention, and for obtaining even better possibilities for setting a desired position of a bracket part relative to the corrugated sheet 1 and relative to each other, the two embodiments shown in FIGS. 4 to 7 can be used.

FIGS. 4*a*, 4*b* and 4*c* show a top view, a side view and a front view respectively of a supporting part 20 according to a second embodiment of the bracket unit according to the invention.

The supporting part 20 has sharply projecting ribs 21, corresponding to the ribs 16 of the first embodiment shown in FIG. 3, on the top side of the supporting part 20 forming a supporting surface. The supporting part 20 has flanges 22 which run downwards from the top side (supporting surface) and which run parallel to each other at a distance d, and at one end each have a bore 23 for the passage of a hinge pin (not shown) which runs at right angles to the supporting part 20 and can be formed by a bolt and a nut, which can be accommodated in a polygonal recess 24 in such a way that they cannot turn. A bore 25 formed by a slot running in the lengthwise direction of the supporting part 20 is suitable for the passage of a bolt 6 (FIG. 1). The bore 25 passes through a chamber 26 which runs in the lengthwise direction of the supporting part 20 and the width of which is greater than the width of the slot 25, and which is suitable for accommodation of a nut, such as a nut 4, in such a way that it can slide and cannot turn therein. The chamber or nut nesting space 26 is bounded at one end by a wall 27 and at another end by a projection 28. The nut 4 can be pushed over the projection 28 into the chamber 26, in which process the projection 28 is elastically deformed and subsequent loss of the nut 4 from the chamber 26 is prevented.

The end of the supporting part 20 at the bores 23 for a hinge pin has between the flanges 22 an insertion space 29 for a coupling part 30 at one end of a bracket part 31, the other, bottom end of which can support therein in clamping fashion a gutter (not shown). The coupling part 30 is of a width which is equal to the distance d between the flanges 22 of the supporting part 20 and has a bore 32 for the passage of the hinge pin after the coupling part 30 is inserted into the insertion space 29. In arc parts 33, 34 with the hinge pin as the centre point, provision is made on the inside of the flanges 22 and on the outside of the coupling part 30 for raised parts and recesses which engage with each other after the coupling part 30 has been inserted in the insertion space 29.

In this second embodiment, before or after the bracket unit is fastened to the roof 1, the bracket part 31 can be turned into a desired angular position and locked therein, so that the bracket unit can be used in a simple manner for roofs with different slopes. This means that relatively few different parts need to be produced and held in stock, so that the cost of this second embodiment can be relatively low.

FIGS. 6 and 7 show another embodiment of the bracket part 31 shown in FIG. 5 for use with the supporting part 20 shown in FIG. 4.

The bracket part shown in FIGS. 6 and 7 comprises two sub-parts 35, 36, of which the sub-part 35 has a head part 37, like the head part 30 of the bracket part 31 of FIG. 5, with a similar arc part 38 with raised parts and recesses for engaging in the arched part 33 of the supporting part 20, and with a bore 39 for the hinge pin conveyed through the bores 23 of the supporting part 20.

The sub-part 35 has a slot-type bore 40 which goes through a chamber 41 which is wider than the slot 40. The chamber 41 is bounded at one end by a wall 42 and at the other end by a projection 43. The chamber 41 can take a nut (not shown) in such a way that it slides and cannot turn therein. This nut can be pushed through an aperture at the projection 43 into the chamber 41, the projection 43 then being elastically deformed, following which loss of the nut from the chamber 41 is prevented.

A top end of the sub-bracket part 36 has a bore 44 for the passage of a bolt (not shown). After the sub-bracket parts 35 and 36 are placed against each other, said bolt can be screwed via the bore 44 into the nut disposed in the chamber 41, and the sub-part 36 can be tightened with an adjustable distance relative to the head part 37, and thus relative to the corrugated sheet 1.

In order to obtain an easy angular setting, a scale division 45 is provided on the outside of a flange of the supporting part 20.

By using only three parts, the supporting part 20 shown in FIG. 4 and the sub-bracket parts 35 and 36 shown in FIGS. 6 and 7, it is therefore possible to fix a gutter to a roof corrugated sheet 1 simply, safely and quickly, with the slope of the corrugated sheet 1 and the desired slope of the gutter being taken into account, and the bores provided for bolts in the corrugated ridges 2 of the corrugated sheet 1 or of different corrugated sheets 1 not having to be precisely in line and at the same level.

The bores 12, 15, 25 for the bolt 6 of the supporting part 3, 20 are preferably provided so close to the end of the supporting part 3, 20 where the bracket part 10, 31, 35 is inserted into the supporting part 3, 20 in order to ensure that as strong a fastening as possible of the bracket unit to the eaves section 1 can be obtained, in which the bracket unit, in particular the supporting part 3, will not sag undesirably through the weight of the gutter and the water which it contains, so that damage to the eaves section is avoided.

I claim:

1. A bracket unit for holding a gutter from a corrugated roof's eaves, said eaves having an underside, said bracket comprising:

an elongated supporting part having a supporting surface for engagement with the underside of said corrugated roof's eaves, said elongated support part having a bore which runs therethrough for insertion of a bolt therein, said bore having an axis which is perpendicular to a plane containing the supporting surface, said bore having a cross-sectional area wherein the length of the cross-sectional area is greater than the width of the cross-sectional area, the length of the cross-sectional area running in the lengthwise direction of said elongated supporting part, an insertion space in said supporting part, a nut nesting space positioned in said bore, said nut nesting space holding and preventing a nut from turning when the bolt engages the nut, said nut nesting space allowing the nut limited movement in the lengthwise direction in said bore;

said nut positioned in said bore nut nesting space and engageable with said, bolt such that said bolt passes through the corrugated roof's eaves, through said bore and into said nut nesting space for engagement with said nut to hold said bracket unit to the underside of said corrugated roof's eaves; and a bracket part having a first end for supporting a gutter and a second end for engagement with said insertion space of said supporting part such that the relative position of said supporting part and said bracket part is adjustable.

2. The bracket unit according to claim 1, whereby said insertion space has walls and the walls of the insertion space and the surface of the second end of the bracket part are suitable for retaining the second end of the bracket part by friction in the insertion space.

3. Bracket unit according to claim 1, whereby the bore of the supporting part is suitable for placing the nut from the supporting surface thereof on the bottom of the nut nesting space, the nesting space is bounded at the side of the supporting surface of the supporting part by the end part of the bracket part which is inserted into the insertion space, and the end part of the bracket part has a bore for passage of the bolt.

4. Bracket unit according to claim 1, whereby one of the boundaries of the nesting space comprises a raised part formed at an infeed aperture for the nut on one of the walls of the nesting space, the infeed aperture for the nut and the raised part being suitable for pushing the nut into the nut nesting space, while the raised part is deformed elastically and subsequent loss of the nut from the nesting space is prevented.

5. Bracket unit according to claim 1, whereby the positioning means comprise the bore of the supporting part and the nut nesting space, while the bore of the supporting part is a slot whose longitudinal axis runs essentially parallel to the longitudinal axis of the supporting part, and the nut nesting space is correspondingly slot-shaped and is suitable for accommodation of the nut in such a way that it slides therein.

6. Bracket unit according to claim 1, whereby the bore of the supporting part is formed a shorter distance away from the end of the supporting part with an insertion aperture for insertion of the bracket part than from the other end of the supporting part.

7. Bracket unit according to claim 1, whereby the insertion space is a slot running in the lengthwise direction of the bracket part.

8. Bracket unit according to claim 1, whereby the positioning means a flange formed at one end of the supporting part and a flange formed at the top end of the bracket part, each flange running in a plane which is perpendicular to the supporting surface of the supporting part, and the flanges having a bore for the passage of a hinge pin running perpendicular to the flanges, in order to permit rotation of the parts relative to each other through a desired angle and to permit locking of the parts relative to each other by means of the locking means.

9. Bracket unit according to claim 8, whereby at least one of the parts has a pair of flanges at a distance (d) from each other which is essentially equal to a flange of the other part which is to be inserted between said pair of flanges.

10. Bracket unit according to claims 8, whereby opposite surfaces of the flanges of the parts have raised parts and recesses running radially relative to the hinge pin and engaging with each other.

11. Bracket unit according to claims 8, whereby an angle setting scale is disposed on at least one of the surfaces of the flanges facing away from each other.

12. Bracket unit according to claim 8 whereby the positioning means comprise intermediate coupling end parts to be joined together and belonging to two sub-bracket parts into which the bracket part is divided, each of the coupling parts having a bore for the passage of another bolt, and the bore of one of the coupling parts being formed by a slot running in the lengthwise direction of the bracket part and opening into a nut nesting chamber with limitations for retaining another nut mating with the other bolt in such a way that it cannot be lost or turned in this space and is slidable in the lengthwise direction of the bracket part.

* * * * *

UNITED STATES PATENT AND TRADEMARK OFFICE

CERTIFICATE OF CORRECTION

PATENT NO. : 4,940,198

DATED : July 10, 1990

INVENTOR(S) : Gerrit J. de Wilde

It is certified that error appears in the above-identified patent and that said Letters Patent is hereby corrected as shown below:

Column 1, line 31, after "bores" insert --, the bolt must be tightened--

Column 1, line 33, delete "bolt must be tightened"

Column 2, line 27, after "bracket" insert --unit shown in Fig. 1--

Column 2, line 62, change "pre sure" to --pressure--

Column 2, line 65, change "ring" to --right--

Column 6, line 56, after "means" insert --comprise--

Column 7, line 3, change "claims" to --claim--

Column 7, line 7, change "claims" to -- claim--

Signed and Sealed this

Twenty-eighth Day of January, 1992

*Attest:*

HARRY F. MANBECK, JR.

*Attesting Officer*

*Commissioner of Patents and Trademarks*